US005551894A

United States Patent [19]

Lin et al.

[11] Patent Number: 5,551,894

[45] Date of Patent: Sep. 3, 1996

[54] ELECTRIC JUNCTION BOX

[76] Inventors: Kuang-Ts'an Lin; Shih-Tzung Liang, both of No. 360, Sec. 1, Min-Sheng N. Rd., Kuei-Shan Hsiang, Taoyuan County, Taiwan

[21] Appl. No.: 374,119

[22] Filed: Jan. 18, 1995

[51] Int. Cl.[6] ..... H01R 13/68

[52] U.S. Cl. ..... 439/621; 439/830

[58] Field of Search ..... 439/830–833, 439/621, 622

[56] References Cited

U.S. PATENT DOCUMENTS

| | | | |
|---|---|---|---|
| 4,722,701 | 2/1988 | Bradt | 439/621 |
| 5,167,541 | 12/1992 | Alves et al. | 439/622 |
| 5,328,392 | 7/1994 | Lin et al. | 439/833 |

*Primary Examiner*—Gary F. Paumen

*Attorney, Agent, or Firm*—Morton J. Rosenberg; David I. Klein

[57] ABSTRACT

An electric junction box including a plurality of conductor holders and fuse holders respectively mounted on a base frame thereof, wherein the conductor holders each has opposite sloping sides sloping downwards outwards; the fuse holders have a respective extension strip respectively welded to the conductor holders; the base frame has a plurality of elongated receiving chambers, which receive the conductor holders respectively, and pairs of opposite tilted end supports vertically disposed at two opposite ends of each receiving chamber and fitting over the two opposite sloping sides of the conductor holders to hold the conductor holders in place.

1 Claim, 4 Drawing Sheets

ELECTRIC JUNCTION BOX

BACKGROUND OF THE INVENTION

The present invention relates to electric junction boxes, and relates more particularly to such an electric junction box which improves the structure of the disclosure of U.S. Pat. No. 5,328, 392,which was issued to the present inventor.

A conventional electric junction box, as shown in FIG. 4, is generally comprised of a base frame (6), a plurality of conductor holders (5) fixedly fastened to the base frame (6) by screws (54), a plurality of fuse holders (52) fastened to respective extension portions (51) of the conductor holders (5) by screws (53), and a cover shell (61) covered on the base frame (6) over the conductor holders (5) and the fuse holders (52). This main drawback of this structure of electric junction box is its complicated assembly procedure. If the screws are loosened, a short circuit or electric shock may happen.

SUMMARY OF THE INVENTION

The present invention has been accomplished to provide an electric junction box which is easy to assemble and safe in use. According to the preferred embodiment of the present invention, the electric junction box comprises a plurality of conductor holders and fuse holders respectively mounted on a base frame thereof, wherein the conductor holders each has opposite sloping sides sloping downwards outwards; the fuse holders have a respective extension strip respectively welded to the conductor holders; the base frame has a plurality of elongated receiving chambers, which receive the conductor holders respectively, and pairs of opposite tilted end supports vertically disposed at two opposite ends of each receiving chamber and fitting over the two opposite sloping sides of the conductor holders to hold the conductor holders in place.

DETAILED DESCRIPTION OF THE PREFERRED EMBODIMENT

Figure 1:
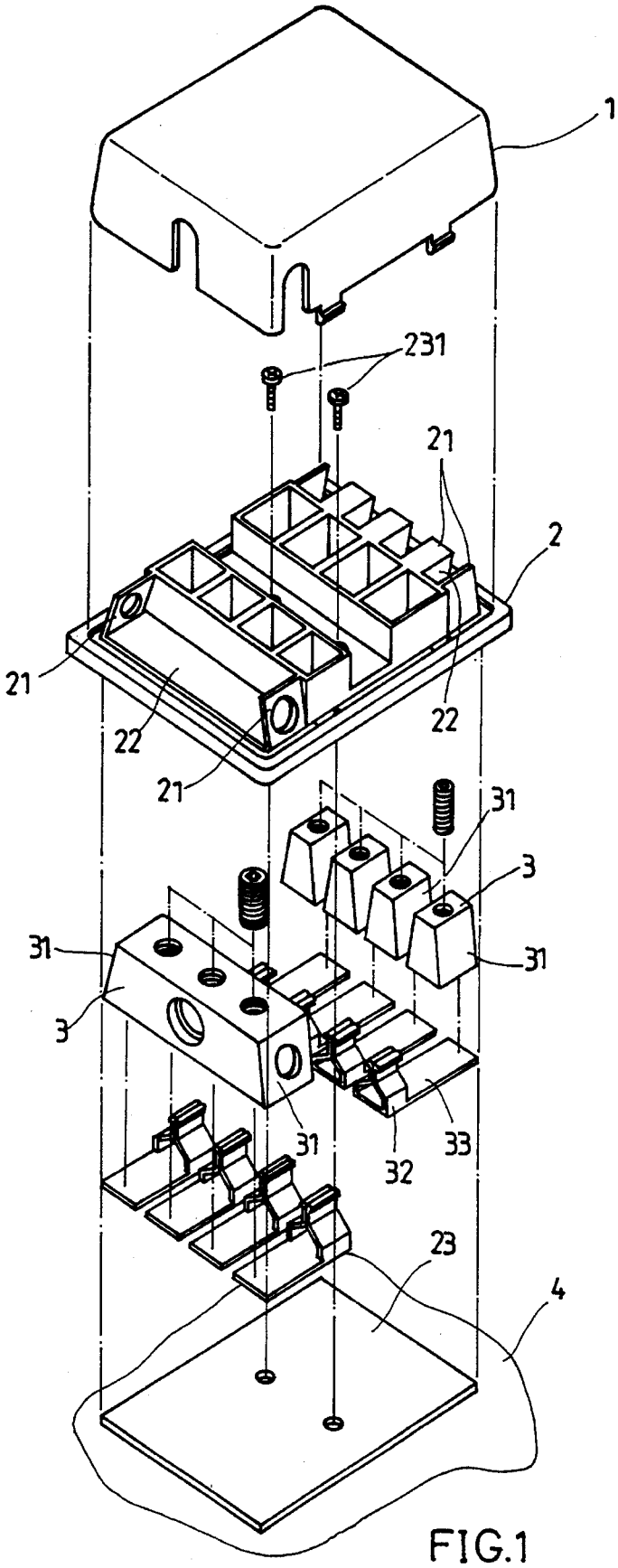
FIG. 1 is an exploded view of an electric junction box according to the present invention.
Figure 2:
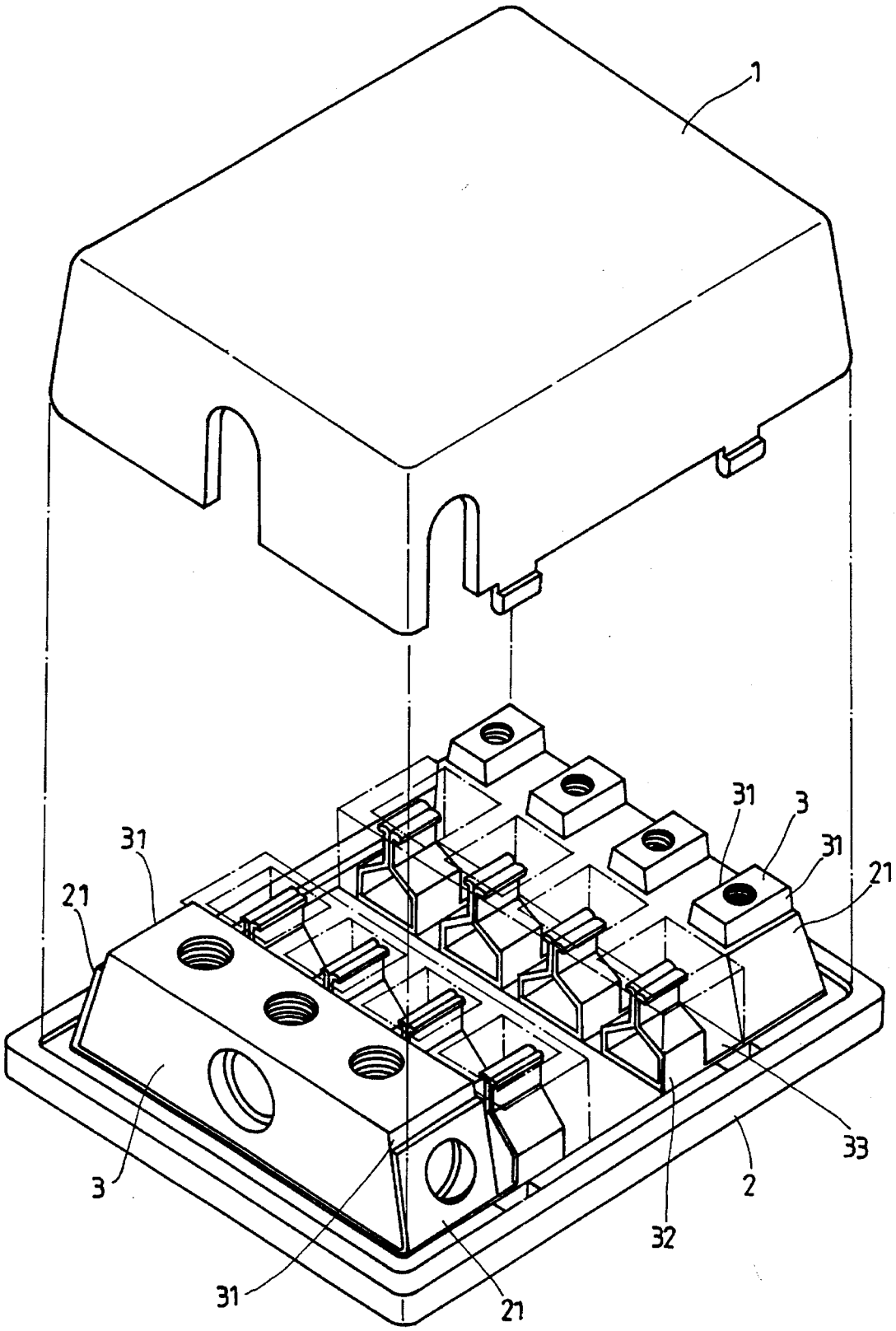
FIG. 2 is a perspective view showing the electric junction box of FIG. 1 assembled before the covering of the cover shell.
Figure 3:
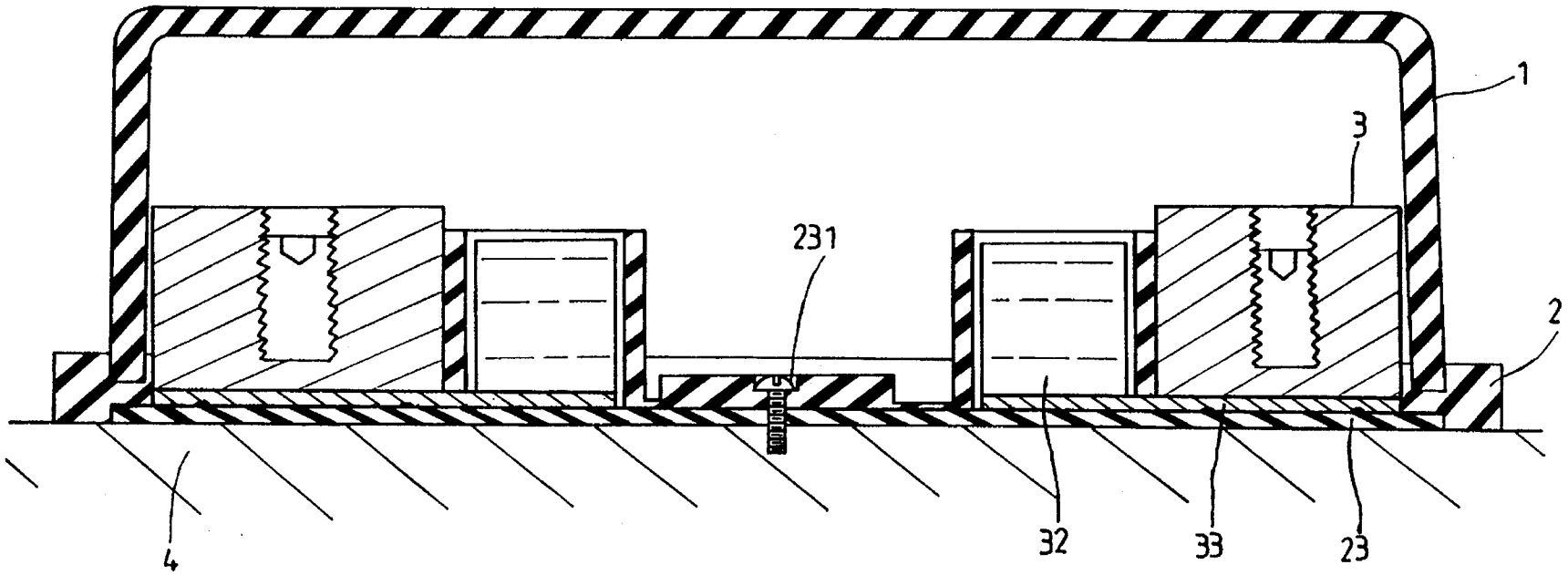
FIG. 3 is a sectional elevation of the electric junction box shown in FIG. 1.
Figure 4:
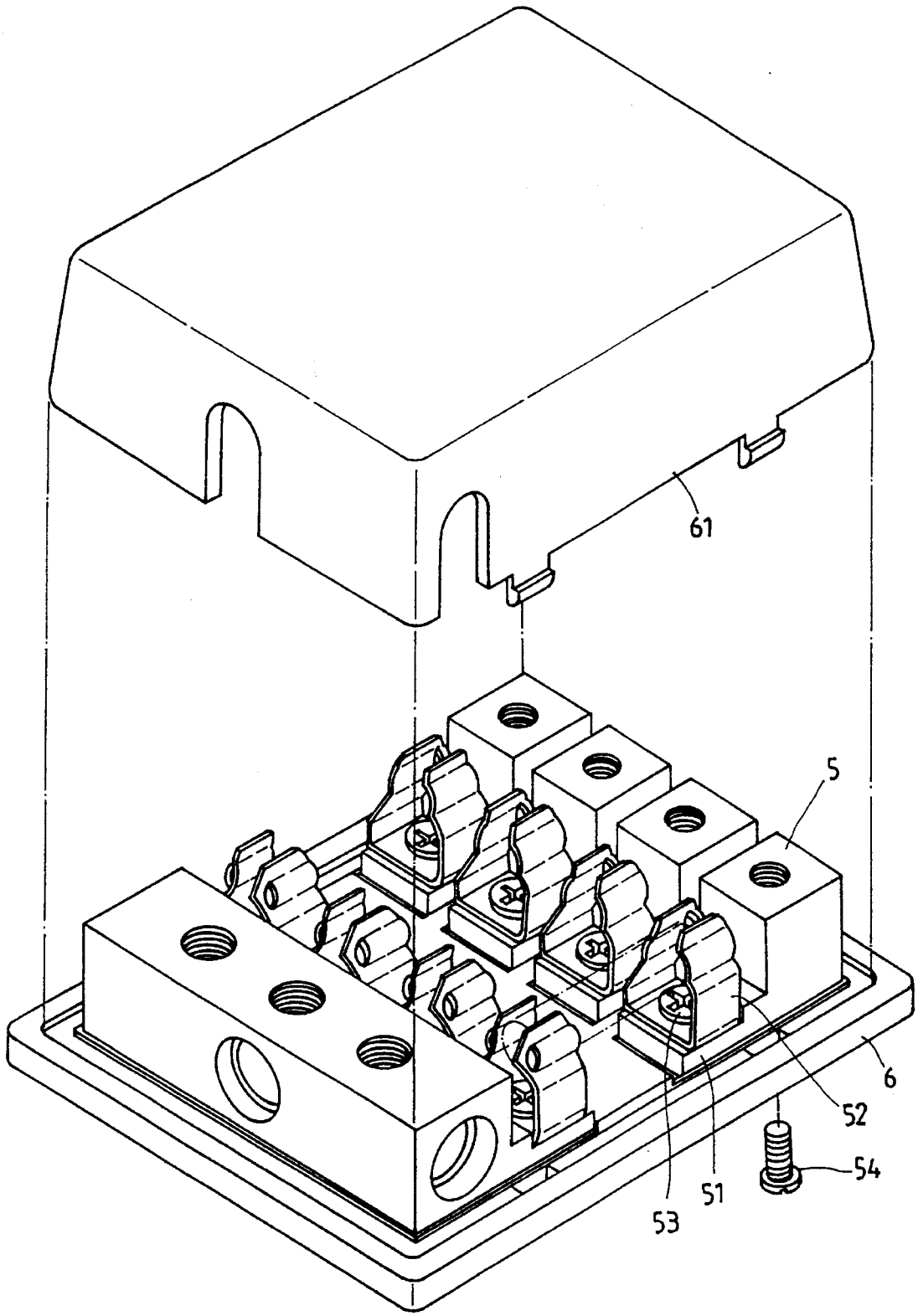
Prior Art FIG.4
FIG. 4 shows an electric junction box according to the prior art.

Referring to FIGS. 1, 2, and 3, an electric junction box is generally comprised of a base frame 2 coupled with a flat bottom plate 23, a plurality of conductor holders 3 and a plurality of fuse holders 32 respectively fastened to the base frame 2 and supported on the flat bottom plate 23, and a cover shell 1 covered on the base frame 2 over the conductor holders 3 and the fuse holders 32. The flat bottom plate 23 is fixedly fastened to a supporting means, for example: the wall 4, by screws 231. The conductor holders 3 each has two opposite sloping sides 31 sloping downwards outwards. The base frame 2 comprises a plurality of elongated receiving chambers 22, which receive the conductor holders 3 respectively, and pairs of opposite tilted end supports 21 vertically disposed at two opposite ends of each receiving chamber 22 and fitting over the two opposite sloping sides 31 of the conductor holders 3 respectively. Because the tilted end supports 21 at each receiving chamber 22 are respectively sloping upwards toward each other and fitting over the two opposite sloping sides 31 of the conductor holders 3 respectively, when the conductor holders 3 are respectively inserted into the receiving chambers 22 from the bottom before the flat bottom plate 23 is fixed to the base frame 2, the conductor holders 3 become firmly retained in place by the tilted end supports 21. The fuse holders 32 have a respective extension strip 33 respectively welded to the bottoms of the conductor holders 3. Therefore, when the electric junction box is installed, the conductor holders 3 and the fuse holders 32 are firmly retained to the base frame 2.

While only one embodiment of the present invention has been shown and described, it will be understood that various modifications and changes could be made without departing from the spirit and scope of the invention.

What is claimed is:

1. An electric junction box comprising a base frame coupled with a flat bottom plate, a plurality of conductor holders and a plurality of fuse holders respectively fastened to the base frame and supported on the flat bottom plate, and a cover shell covered on said base frame over said conductor holders and said fuse holders, wherein said conductor holders each have two opposite sloping sides sloping downwards and outwards; said fuse holders each have a respective extension strip respectively welded to said conductor holders; said base frame comprises a plurality of elongated receiving chambers, which receive said conductor holders respectively, and pairs of opposite tilted end supports disposed at two opposite ends of each receiving chamber and fitting over the two opposite sloping sides of said conductor holders to hold said conductor holders in place.

* * * * *